US009914311B2

(12) United States Patent
Kanno

(10) Patent No.: US 9,914,311 B2
(45) Date of Patent: Mar. 13, 2018

(54) IMAGE FORMATION APPARATUS AND IMAGE FORMATION METHOD

(71) Applicant: Oki Data Corporation, Tokyo (JP)

(72) Inventor: Hiroyuki Kanno, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/207,627

(22) Filed: Jul. 12, 2016

(65) Prior Publication Data

US 2017/0028749 A1 Feb. 2, 2017

(30) Foreign Application Priority Data

Jul. 31, 2015 (JP) ..... 2015-152322

(51) Int. Cl.
*B41J 2/00* (2006.01)
*B41J 3/407* (2006.01)
*B41J 11/00* (2006.01)

(52) U.S. Cl.
CPC ..... *B41J 3/4075* (2013.01); *B41J 11/0095* (2013.01)

(58) Field of Classification Search
None
See application file for complete search history.

(56) References Cited

U.S. PATENT DOCUMENTS

2005/0285717 A1* 12/2005 Ieda ..... B60Q 1/2669 340/5.72
2014/0152753 A1* 6/2014 Moriyama ..... B41J 11/009 347/110

FOREIGN PATENT DOCUMENTS

JP H04-085241 A 3/1992

* cited by examiner

*Primary Examiner* — Matthew Luu
*Assistant Examiner* — Tracey McMillion
(74) *Attorney, Agent, or Firm* — Metrolexis Law Group, PLLC

(57) ABSTRACT

An image formation apparatus includes: a feeder that feeds a label sheet, having a long base sheet and labels detachably adhered to the base sheet at a predetermined interval in a longitudinal direction thereof, to a conveyance path; a conveyance member that conveys the fed label sheet along the conveyance path; a detector that is placed along the conveyance path and that detects a position of at least one of the labels on the label sheet being conveyed; an image formation unit that is placed downstream of the detector in a conveyance direction and that forms an image on the label detected by the detector; and a controller that controls the conveyance member, the detector, and the image formation unit. The controller switches the detector between a constant light emission operation of emitting the detection light constantly and an intermittent light emission operation of emitting the detection light intermittently.

19 Claims, 7 Drawing Sheets

CONFIGURATION OF IMAGE FORMATION APPARATUS (1)

CONFIGURATION OF IMAGE FORMATION APPARATUS (1)

CONFIGURATION OF IMAGE FORMATION APPARATUS (2)

LABEL-LENGTH GAP-LENGTH MEASUREMENT PROCESSING

AUTOMATIC-CUTTER SENSOR DRIVE CONTROL PROCESSING

IMAGE FORMATION UNIT SENSOR DRIVE CONTROL PROCESSING

FUNCTIONAL CONFIGURATION OF IMAGE FORMATION APPARATUS

IMAGE FORMATION APPARATUS AND IMAGE FORMATION METHOD

CROSS REFERENCE TO RELATED APPLICATIONS

This application claims priority based on 35 USC 119 from prior Japanese Patent Application No. 2015-152322 filed on Jul. 31, 2015, entitled "IMAGE FORMATION APPARATUS AND IMAGE FORMATION METHOD", the entire contents of which are incorporated herein by reference.

BACKGROUND OF THE INVENTION

1. Field of the Invention

The disclosure relates to an image formation apparatus and an image formation method, which are advantageously applicable to an image formation apparatus that uses an optical sensor as a detector of the position of a label sheet to control the conveyance of the label sheet and that controls the timing for driving the optical sensor.

2. Description of Related Art

A conventional image formation apparatus uses an optical sensor, such as a transmission sensor or a reflective sensor, to detect the position of a medium being conveyed or to identify a position to start image formation. After the detection, the apparatus conveys the medium by a predetermined amount based on a result of the detection by the optical sensor, and then starts certain processing among various kinds of processing such as printing. Such an optical sensor has variations in the light emission characteristics and light reception characteristics among sensor elements and decreases in light emission due to deterioration with age. For a stable media detection, an apparatus is known for adjusting a slice level in an optical sensor (see, for example, Japanese Patent Application Publication No. Hei 04-085241).

SUMMARY OF THE INVENTION

However, the adjustment of the slice level has a limit in compensating for a decrease in the amount of light emission of optical sensors due to aging deterioration. Thus, periodic replacement of optical sensors is still necessary. Long-lived optical sensors are therefore desired.

An object of an embodiment of the invention is to provide an image formation apparatus capable of increasing the life of an optical sensor.

A first aspect of the invention is an image formation apparatus that includes: a feeder that feeds a label sheet to a conveyance path, the label sheet including a long base sheet and a plurality of labels detachably adhered to the base sheet with a gap of a predetermined length interposed in between in a longitudinal direction of the base sheet; a conveyance member that conveys the fed label sheet along the conveyance path; a detector that is placed along the conveyance path and that detects a position of at least one of the labels on the label sheet by emitting a detection light to the label sheet being conveyed; an image formation unit that is placed downstream of the detector in a conveyance direction and that forms an image on the label detected by the detector; and a controller that controls the conveyance member, the detector, and the image formation unit. The controller switches the detector between a constant light emission operation of emitting the detection light constantly and an intermittent light emission operation of emitting the detection light intermittently.

A second aspect of the invention is an image formation method that includes: causing a feeder to feed a label sheet to a conveyance path, the label sheet including a long base sheet and a plurality of labels detachably adhered to the base sheet with a gap of a predetermined length interposed in between in a longitudinal direction of the sheet; causing a conveyance member to convey the fed label sheet along the conveyance path; causing a detector placed along the conveyance path to detect a position of each label on the label sheet by emitting a detection light to the label sheet being conveyed; and causing an image formation unit placed downstream of the detector in a conveyance direction to form an image on the label detected by the detector. The label position detection step includes a constant light emission operation of emitting the detection light constantly and an intermittent light emission operation of emitting the detection light intermittently.

The above aspect(s) of the invention can reduce the light emission time per unit time by performing constant light emission operation for an area which needs accurate label detection, and by emitting light at long intervals for an area which does not need the accurate label detection. Thus, the aspect(s) can achieve an image formation apparatus and an image formation method capable of increasing sensor life.

DETAILED DESCRIPTION OF EMBODIMENTS

Figure 1:
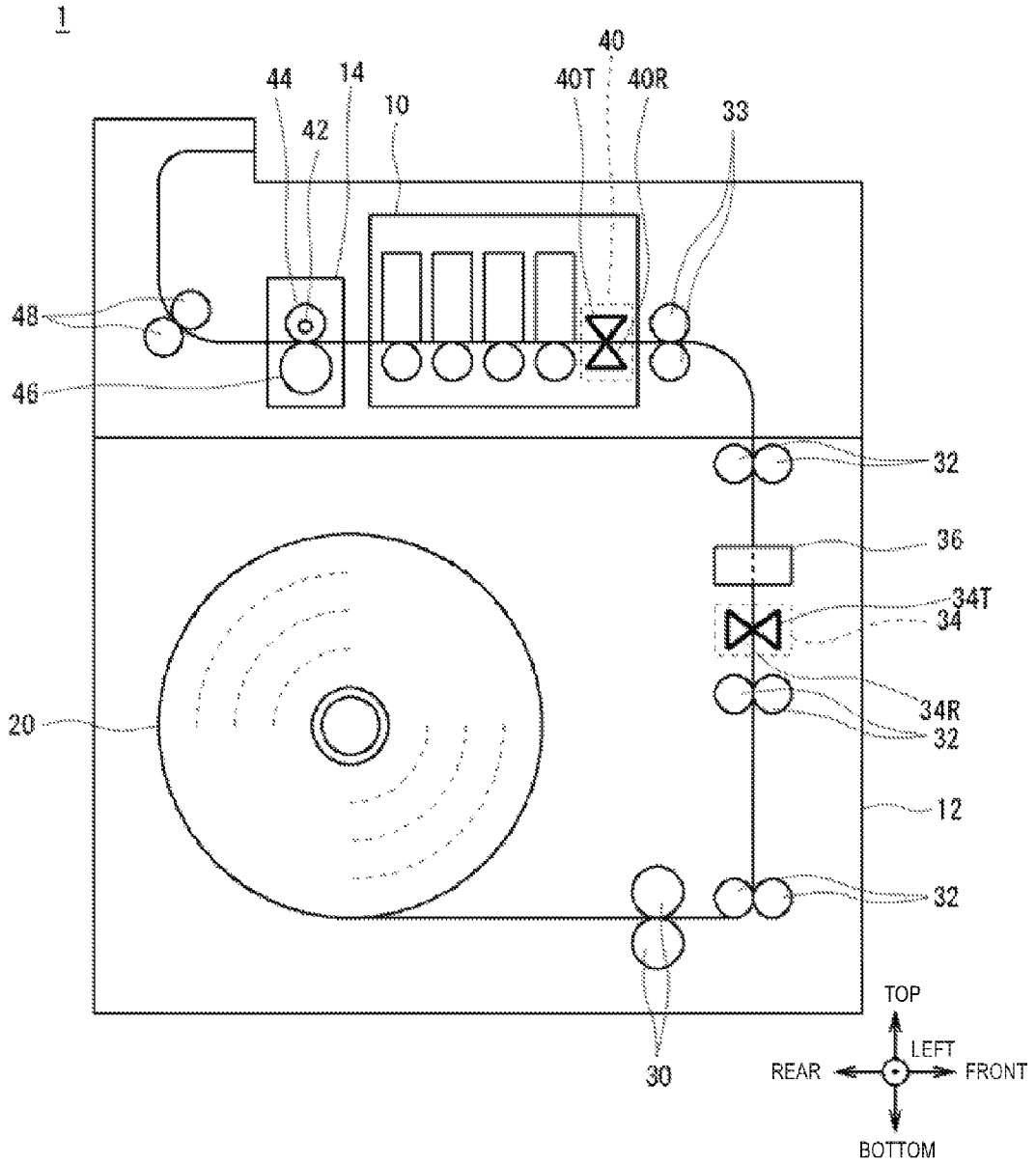
FIG. 1 is a left side view illustrating a configuration of an image formation apparatus.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

1. Embodiment

1-1. Configuration of the Image Formation Apparatus

Figure 2:
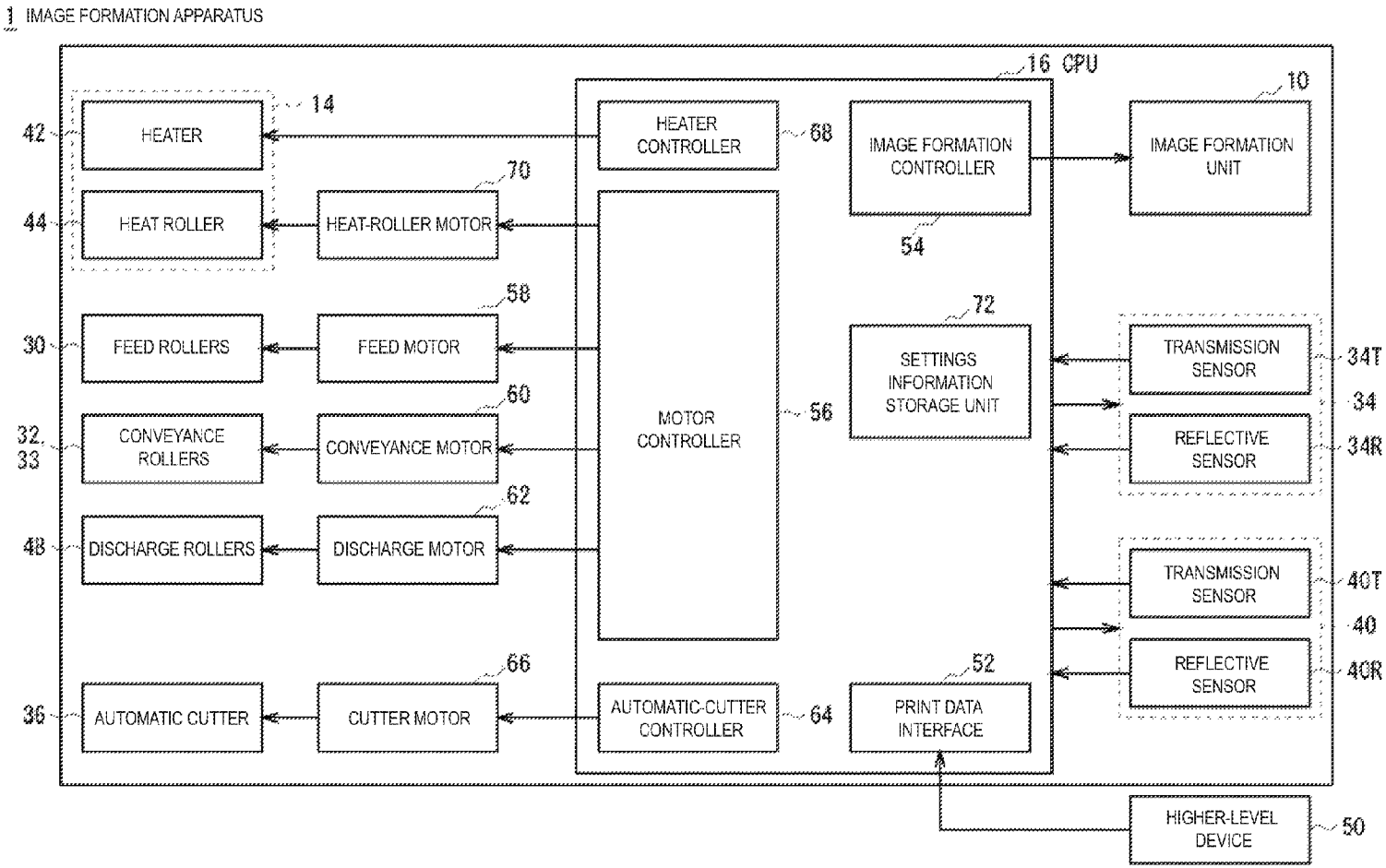
FIG. 2 is a block diagram illustrating the configuration of the image formation apparatus.

As illustrated in FIG. 1, image formation apparatus 1 includes image formation unit 10, feeder unit 12, and fuser unit 14. As illustrated in FIG. 2, image formation apparatus 1 has central processing unit (CPU) 16 which performs an overall control of image formation apparatus 1. CPU 16 controls each unit of image formation apparatus 1 by executing certain programs read from a storage unit that includes a read-only memory (ROM), a random access memory (RAM), a hard disk drive, or a flash memory.

Figures 3A, 3B, 3C:
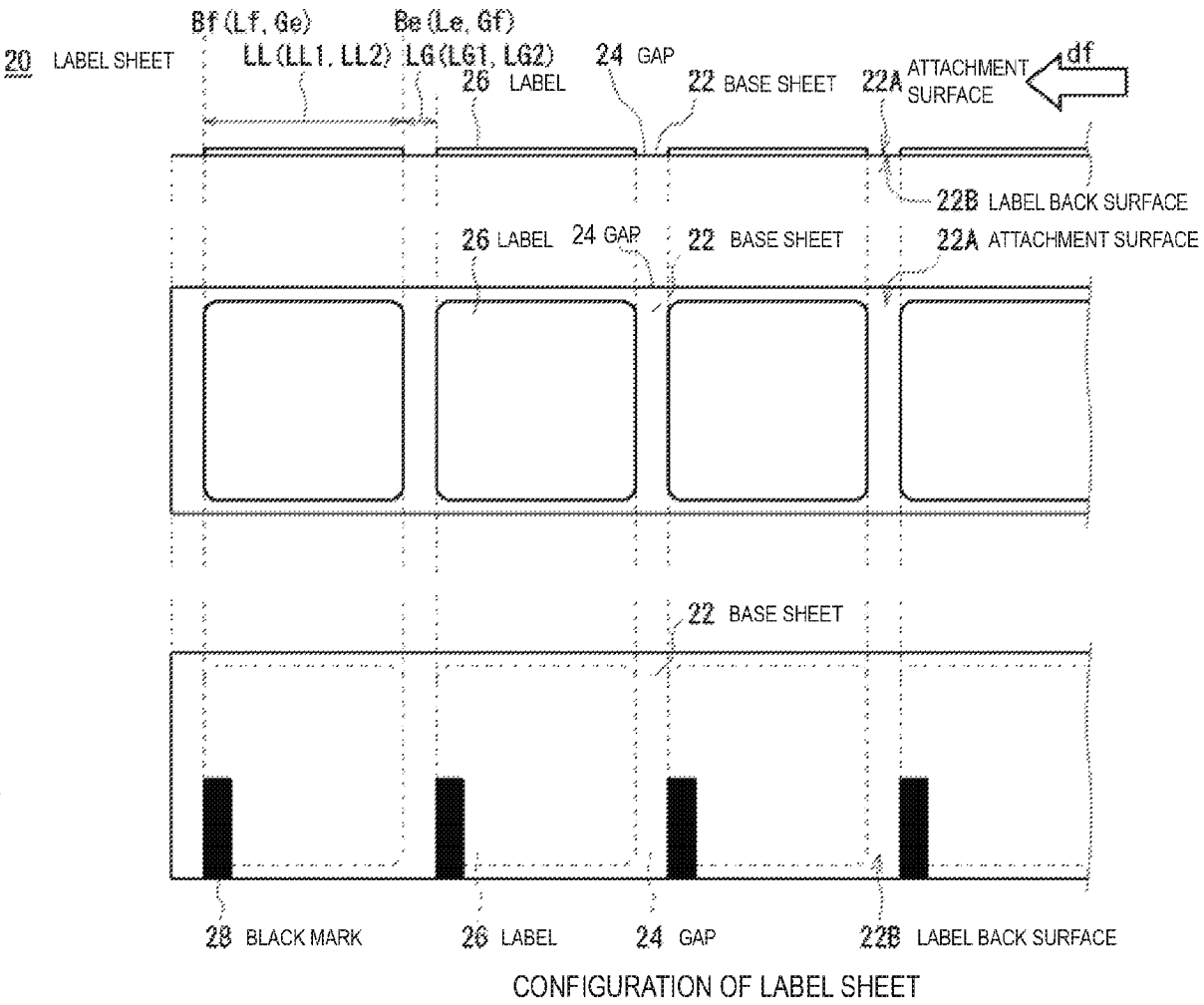
FIGS. 3A to 3C illustrate a configuration of a label sheet, FIG. 3A illustrating a side view of the label sheet, FIG. 3B illustrating an attachment surface of the label sheet, and FIG. 3C illustrating the back surface of the label sheet.

Feeder unit 12 is placed in a lower part of image formation apparatus 1, and has feed rollers 30, conveyance rollers 32, automatic-cutter sensor 34, and automatic cutter 36. Feeder unit 12 has long label sheet 20 thereinside. As illustrated in FIGS. 3A to 3C, label sheet 20 is formed by temporarily attaching, or detachably adhering, substantially square labels 26 to attachment surface 22A (or a temporary attachment surface) of long base sheet 22 (one of the surfaces of base sheet 22) in such a manner that labels 26 are arranged at equal intervals in a longitudinal direction of base sheet 22 (the conveyance direction df). A gap 24 of a predetermined length in the longitudinal direction of base sheet 22 is interposed between labels 26. Base sheet 22 is rolled up. On label back surface 22B of base sheet 22, which is the opposite surface from attachment surface 22A, black marks 28 are printed beforehand as indications of leading edges of labels 26, in the conveyance direction, temporarily attached or detachably adhered to attachment surface 22A. Each black mark 28 is printed at a position coinciding with the leading edge of a corresponding one of labels 26. Black marks 28 thus indicate the positions of labels 26 detachably adhered to attachment surface 22A, which is the opposite surface from label back surface 22B on which black marks 28 are printed. Hereinafter, the length of labels 26 in conveyance direction df is also called label length LL, and an interspace between adjacent labels 26 in conveyance direction df, i.e., the length of gap 24 in conveyance direction df, is also called gap length LG.

Feed rollers 30 and conveyance rollers 32 (FIG. 1) are placed on a conveyance path of label sheet 20, and convey label sheet 20 to image formation unit 10 by rotating while sandwiching label sheet 20.

Automatic-cutter sensor 34 as a cutter mechanism is an optical sensor using, for example, a light emitting diode (LED), and is placed upstream of automatic cutter 36 in conveyance direction df. Automatic-cutter sensor 34 includes automatic-cutter transmission sensor 34T and automatic-cutter reflective sensor 34R, and identifies labels 26, base sheet 22, and black marks 28 of label sheet 20. Automatic-cutter transmission sensor 34T detects labels 26 and base sheet 22 as follows. A light emitting part of automatic-cutter transmission sensor 34T is placed on the side close to attachment surface 22A of label sheet 20 and emits a detection light to a predetermined detection target point. A light receiving part of automatic-cutter transmission sensor 34T is placed on the side close to label back surface 22B and receives a transmission light which is the detection light having been transmitted through label sheet 20. Automatic-cutter transmission sensor 34T detects labels 26 and base sheet 22 based on the difference in light transmittance between labels 26 and base sheet 22, and sends the detection results to CPU 16. Automatic-cutter reflective sensor 34R detects labels 26 as follows. A light emitting part of automatic-cutter reflective sensor 34R is placed on the side close to label back surface 22B of label sheet 20 and applies a detection light to a predetermined detection target point. A light receiving part of automatic-cutter reflective sensor 34R is also placed on the side close to label back surface 22B and receives a reflective light which is the detection light reflected on label sheet 20. Automatic-cutter reflective sensor 34R detects labels 26 based on the difference in the light reflectance between base sheet 22 and black marks 28, and sends its detection results to CPU 16. Under the control of CPU 16, automatic-cutter sensor 34 is switched between a constant driving mode and an intermittent driving mode. In the constant driving mode, automatic-cutter sensor 34 performs a constant light emission operation and emits the detection light constantly. In the intermittent driving mode, automatic-cutter sensor 34 performs an intermittent light emission operation and emits the detection light intermittently.

Automatic cutter 36 as the cutter mechanism is placed downstream of automatic-cutter sensor 34 in conveyance direction df. Under the control of CPU 16, automatic cutter 36 cuts gaps 24 of label sheet 20 in the width direction of label sheet 20 which is orthogonal to convey direction df. Automatic cutter 36 thereby divides label sheet 20 into individual label sheets each containing a single label 26 and a piece of base sheet 22 for that label 26. CPU 16 sets a cutting position so that the timing and the position may coincide based on a detection result from automatic-cutter sensor 34. CPU 16 controls automatic cutter 36 accordingly. Specifically, CPU 16 sets the gap cutting timing for automatic-cutter sensor 34 as follows. CPU 16 takes, as a reference, a point of time when automatic-cutter sensor 34 detects the leading edge of certain label 26 in conveyance direction df. When label sheet 20 is conveyed by a predetermined amount from the reference point of time, automatic-cutter 36 cuts gap 24 corresponding to that certain label 26. The individual label sheets thus divided are supplied to image formation unit 10 by conveyance rollers 33.

Image formation unit sensor 40 is placed upstream of image formation unit 10 in conveyance direction df, and is, like automatic-cutter sensor 34, an LED optical sensor or the like. Image formation unit sensor 40 includes image formation unit transmission sensor 40T and image formation unit reflective sensor 40R which are configured similarly to automatic-cutter transmission sensor 34T and automatic-cutter reflective sensor 34R, respectively. Under the control of CPU 16, image formation unit sensor 40 is switched between a constant driving mode and an intermittent driving mode. In the constant driving mode, image formation unit sensor 40 performs a constant light emission operation and emits the detection light constantly. In the intermittent driving mode, image formation unit sensor 40 performs an intermittent light emission operation and emits the detection light intermittently.

Image formation unit 10 is placed in an upper part of image formation apparatus 1, and under the control of CPU 16, performs image formation by forming a toner image on label 26 of an individual label sheet. In this event, CPU 16 sets a position for forming the image on label 26 so that the timing and the position coincide based on a detection result from image formation unit sensor 40. CPU 16 controls image formation unit 10 accordingly. The individual label sheet on which a toner image has been formed is conveyed downstream in conveyance direction df and passes through fuser unit 14.

Fuser unit 14 includes heat roller 44 with heater 42 inside and fuser belt 46 which presses an individual label sheet against heat roller 44. Fuser unit 14 fixes the toner image onto the individual label sheet by sandwiching the individual label sheet between heat roller 44 and fuser belt 46 and thermally fusing and pressing the toner. Discharge rollers 48 convey the individual label sheet on which the toner image has been fixed and discharge the individual label sheet to the outside of image formation apparatus 1.

In image formation apparatus 1 thus configured, automatic cutter 36 cuts gap 24 at an appropriate position on label sheet 20 based on a detection result from automatic-cutter sensor 34, and image formation unit 10 forms an image on label 26 at an appropriate position on the individual label sheet based on a detection result from image formation unit sensor 40.

As illustrated in FIG. 2, CPU 16 receives print data from higher-level device 50, such as a personal computer, through print data interface 52, and causes image formation controller 54 to convert the print data into image data. To convey label sheet 20, CPU 16 causes motor controller 56 to control feed motor 58 which drives feed rollers 30, to control conveyance motor 60 which drives conveyance rollers 32, 33, and to control discharge motor 62 which drives discharge rollers 48. Meanwhile, during the conveyance of label sheet 20, CPU 16 causes automatic-cutter sensor 34 and image formation unit sensor 40 to monitor how label sheet 20 is conveyed. In addition, CPU 16 causes heater controller 68 to control the temperature of heater 42 of fuser unit 14, and causes motor controller 56 to control the rotation of heat-roller motor 70 which drives heat roller 44. After the temperature of heater 42 reaches an appropriate value, CPU 16 causes motor controller 56 to control feed motor 58 and conveyance motor 60 to start conveying label sheet 20.

Automatic-cutter controller 64 monitors a detection result from automatic-cutter sensor 34. When label sheet 20 arrives at a preset cutting position, automatic-cutter controller 64 drives cutter motor 66 to cause automatic cutter 36 to cut label sheet 20. Image formation controller 54 monitors a detection result from image formation unit sensor 40, and when acquiring a detection result that indicates detection of an individual label sheet, transfers image data to image formation unit 10 and forms a toner image on label 26 of the individual label sheet. CPU 16 causes motor controller 56 to control heat-roller motor 70 so that an individual label sheet with a toner image formed thereon is conveyed downstream in conveyance direction df, and CPU 16 controls fuser unit 14 to fix the toner image. CPU 16 causes motor controller 56 to control discharge motor 62 so that the individual label sheet is conveyed further downstream in conveyance direction df and is discharged from image formation apparatus 1.

Settings information storage unit 72 stores information such as the types and sizes of label sheets 20 used and values set as cutting positions. Those pieces of information are read from or are written into settings information storage unit 72 by CPU 16 as needed.

1-2. Label-Length Gap-Length Measurement Processing

Figure 4:
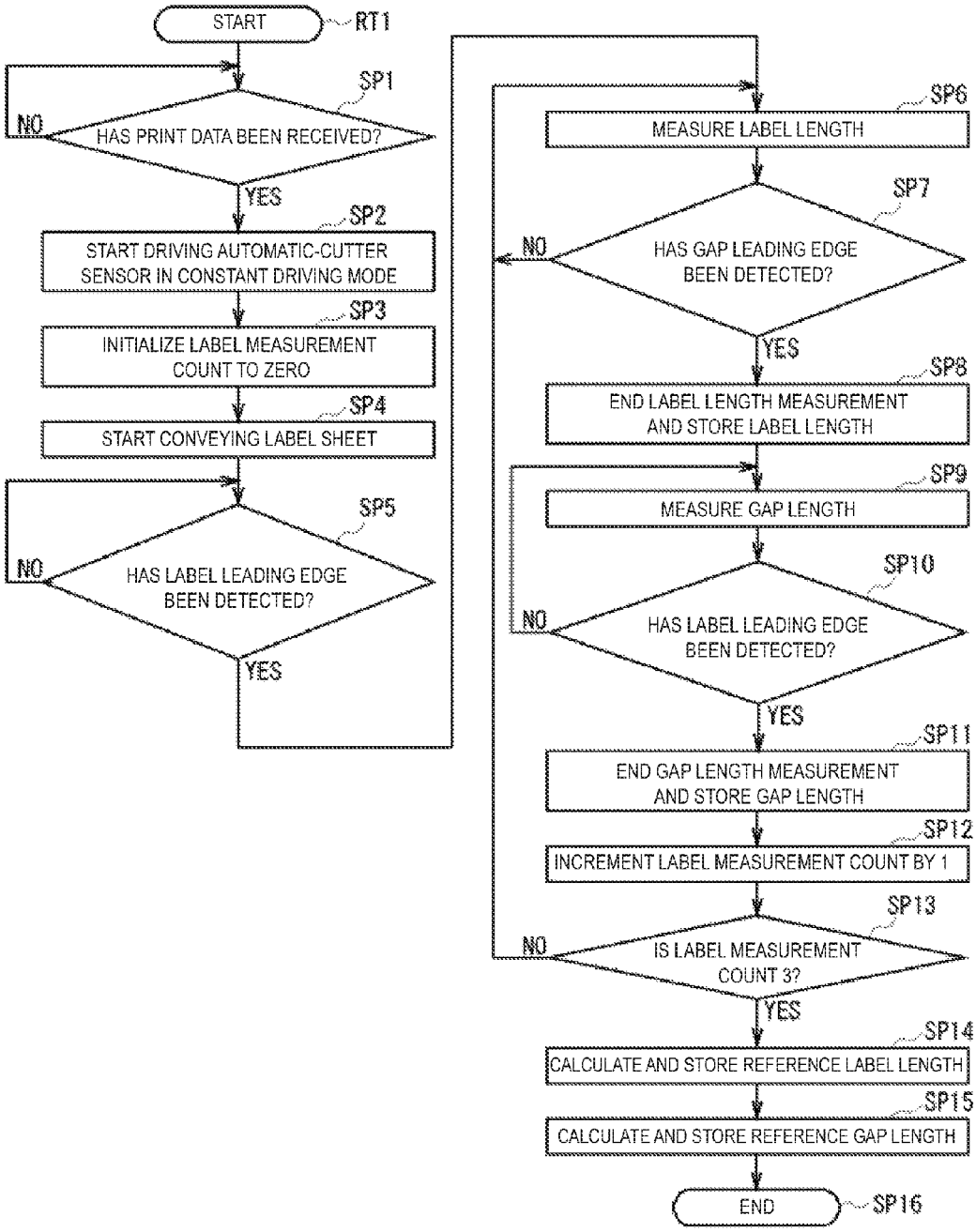
FIG. 4 is a flowchart illustrating label-length gap-length measurement processing.

Using the flowchart in FIG. 4, a detailed description is given of label-length gap-length measurement processing performed by image formation apparatus 1. When a user powers on image formation apparatus 1, CPU 16 starts label-length gap-length measurement processing RT1 by executing a label-length gap-length measurement processing program read from the ROM, and proceeds to Step SP1.

In Step SP1, CPU 16 waits for print data from higher-level device 50 through print data interface 52. Upon receipt of print data, CPU 16 proceeds to Step SP2 to cause automatic-cutter sensor 34 to emit light, i.e., start driving automatic-cutter sensor 34 in the constant driving mode, and proceeds to Step SP3. In the constant driving mode, automatic-cutter transmission sensor 34T and automatic-cutter reflective sensor 34R of automatic-cutter sensor 34 keep emitting detection light. In Step SP3, CPU 16 initializes label measurement count CL to zero. Although described later, label measurement count CL is the number of measurements of label length LL and gap length LG. CPU 16 then proceeds to Step SP4 where CPU 16 starts the conveyance of label sheet 20 by causing motor controller 56 to control feed motor 58, conveyance motor 60, and discharge motor 62 so that they drive feed rollers 30, conveyance rollers 32, 33, and discharge rollers 48, respectively. CPU 16 then proceeds to Step SP5.

In Step SP5, CPU 16 waits until automatic-cutter sensor 34 detects label leading edge Lf (FIG. 3) of label 26 on label sheet 20, which is a leading edge of label 26 in conveyance direction df. When label leading edge Lf is detected, CPU 16 proceeds to Step SP6 to start measuring label length LL. CPU then proceeds to Step SP7 to determine whether automatic-cutter sensor 34 has detected label trailing edge Le (FIG. 3) which is the trailing edge of label 26 on label sheet 20 in conveyance direction df, i.e., gap leading edge Gf (FIG. 3) which is the leading edge of gap 24 on label sheet 20 in conveyance direction df. This gap 24 is immediately rearward of the aforementioned label 26 in conveyance direction df. When the determination in Step SP7 is negative, indicating that automatic-cutter sensor 34 is still detecting label 26, CPU 16 proceeds back to Step SP6 to continue the measurement of label length LL. When the determination in Step SP7 is affirmative, indicating that automatic-cutter sensor 34 has detected label trailing edge Le, CPU 16 proceeds to Step SP8. In Step SP8, CPU 16 ends the measurement of label length LL, which is the length from label leading edge Lf to label trailing edge Le. CPU 16 stores label length LL in settings information storage unit 72 as measured label length LL1, and proceeds to Step SP9. Hereinbelow, label leading edge Lf and gap trailing edge Ge are also referred to as label leading edge boarder Bf (FIG. 3). Label trailing edge Le and gap leading edge Gf are also referred to as label trailing edge boarder Be (FIG. 3).

In Step SP9, CPU 16 starts measuring gap length LG, and proceeds to Step SP10. In Step SP10, CPU 16 determines whether automatic-cutter sensor 34 has detected gap trailing edge Ge which is the trailing edge of gap 24 on label sheet 20 in conveyance direction df, i.e., label leading edge Lf of label 26 on label sheet 20 located immediately rearward of the aforementioned gap 24 in conveyance direction df. When the determination in Step SP10 is negative, indicating that automatic-cutter sensor 34 is still detecting gap 24, CPU 16 proceeds back to Step SP9 to continue the measurement of gap length LG. When the determination in Step SP10 is affirmative, indicating that automatic-cutter sensor 34 has detected gap trailing edge Ge, CPU 16 proceeds to Step SP11. In Step SP11, CPU 16 ends the measurement of gap length LG, which is the length from gap leading edge Gf to gap trailing edge Ge. CPU 16 stores gap length LG in settings information storage unit 72 as measured gap length LG1, and proceeds to Step SP12.

In Step SP12, CPU 16 increments label measurement count CL by 1, and proceeds to Step SP13. In Step SP13, CPU 16 determines whether label measurement count CL is three. If the determination in Step SP13 is negative, indicating that label length LL and gap length LG have not been measured three times yet, CPU 16 proceeds back to Step SP6 to start measuring label length LL of label 26 located rearward in conveyance direction df. When the determination in Step SP13 is affirmative, indicating that label length LL and gap length LG have been measured three times, CPU 16 proceeds to Step SP14.

In Step SP14, CPU 16 calculates the average of measured label lengths LL1 for three labels 26 stored in settings information storage unit 72 and thereby obtains reference label length SLL. CPU 16 stores reference label length SLL in settings information storage unit 72, and proceeds to Step SP15. In Step SP15, CPU 16 calculates the average of measured gap lengths LG1 for three gaps 24 stored in settings information storage unit 72 and thereby obtains reference gap length SLG. CPU 16 stores reference gap length SLG in settings information storage unit 72, and proceeds to Step SP16 to end label-length gap-length measurement processing RT1.

As described above, upon the start of printing, CPU 16 obtains measured label lengths LL1 for three labels 26 and measured gap lengths LG1 for three gaps 24 from the frontmost ones in conveyance direction df, averages measured label lengths LL1 and measured gap lengths LG1 to obtain reference label length SLL and reference gap length SLG, respectively, and stores reference label length SLL and reference gap length SLG in settings information storage unit 72.

1-3. Automatic-Cutter Sensor Drive Control Processing

Figure 5:
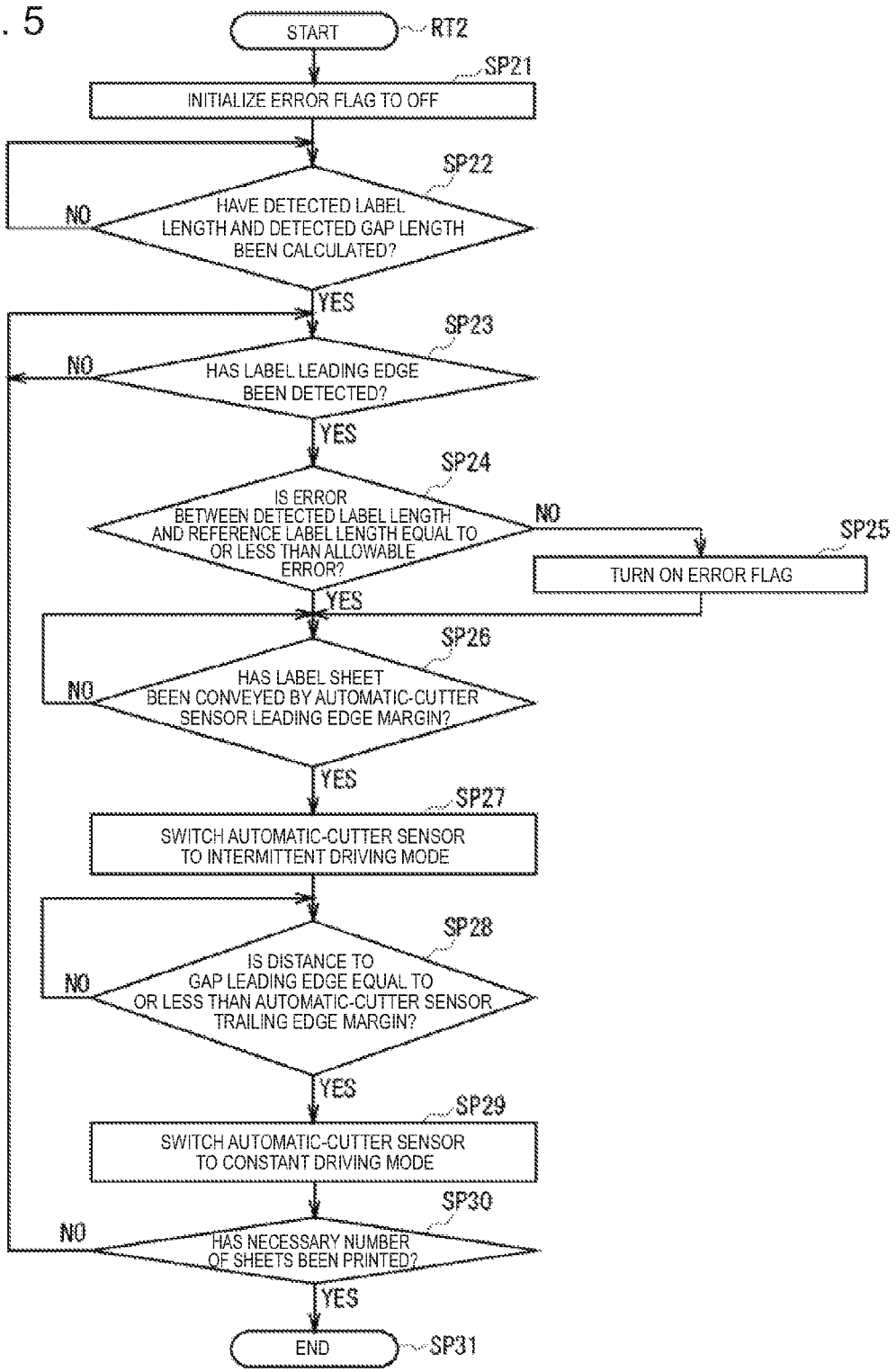
FIG. 5 is a flowchart illustrating automatic-cutter sensor drive control processing.

Using the flowchart in FIG. 5, a detailed description is given of automatic-cutter sensor drive control processing performed by image formation apparatus 1. When label-length gap-length measurement processing RT1 ends, CPU 16 starts automatic-cutter sensor drive control processing RT2 by executing an automatic-cutter sensor drive control processing program read from the ROM, and proceeds to Step SP 21. In this state, CPU 16 is driving automatic-cutter sensor 34 in the constant driving mode, and is continuing the conveyance of label sheet 20.

In Step SP21, CPU 16 initializes, i.e., turns off, an error flag indicating that there is a large error between reference label length SLL and label length LL of label 26 which is measured in label-length gap-length measurement processing RT1, or that there is label 26 exceeding an allowable error. CPU 16 then proceeds to Step SP22 in which CPU 16 performs a processing similar to that performed in Steps SP5 to SP11 in label-length gap-length measurement processing RT1. CPU 16 then waits for the measurement of label length LL of label 26 which is the fourth label from the start of the printing and the measurement of gap length LG of gap 24 immediately rearward of the fourth label 26 in conveyance direction df. CPU 16 stores label length LL and gap length LG in settings information storage unit 72 as detected label length LL2 and detected gap length LG2, and proceeds to Step SP23.

In Step SP23, CPU 16 waits until automatic-cutter sensor 34 detects label leading edge Lf of label 26 on label sheet 20. Upon detection of label leading edge Lf, CPU 16 proceeds to Step SP24 to determine whether an error between detected label length LL2 and reference label length SLL is equal to or less than an allowable error. The allowable error indicates how much error is allowed between reference label length SLL and detected label length LL2. Different processing is performed in image formation unit sensor drive control processing RT3 (described later), depending on whether or not the error between reference label length SLL and detected label length LL2 exceeds the allowable error. The allowable error is set to 1% in the present embodiment. When the determination in Step SP24 is negative, indicating that label 26 with a large error is being conveyed or that label sheet 20 is made of a slippery material and causing a large conveyance error, CPU 16 proceeds to Step SP25 to turn the error flag on, and then proceeds to Step SP26. When the determination in Step SP24 is affirmative, indicating that the size of label 26 is equal to or less than the allowable error, CPU 16 proceeds to Step SP26.

In Step SP26, CPU 16 waits until label sheet 20 is conveyed by a distance of an automatic-cutter sensor leading edge margin, the distance starting from label leading edge Lf detected in Step SP23. When label sheet 20 is conveyed by that distance, CPU 16 continues conveying label sheet 20 and proceeds to Step SP27 to switch automatic-cutter sensor 34 to the intermittent driving mode. CPU 16 then proceeds to Step SP28. The automatic-cutter sensor leading edge margin is a distance in conveyance direction df from when the detection target point of automatic-cutter sensor 34 in the constant driving mode passes label leading edge Lf to when automatic-cutter sensor 34 is switched to the intermittent driving mode. In the present embodiment, the automatic-cutter sensor leading edge margin is set to 10% of reference label length SLL. In the intermittent driving mode, automatic-cutter transmission sensor 34T and automatic-cutter reflective sensor 34R of automatic-cutter sensor 34 keep turning on and off on a predetermined regular cycle, emitting light intermittently.

In Step SP28, CPU 16 waits until a distance from a point on label 26 currently passing the detection target point of automatic-cutter sensor 34 to gap leading edge Gf of gap 24 immediately rearward, in conveyance direction df, of label 26 currently detected by automatic-cutter sensor 34 falls to or below a distance of an automatic-cutter sensor trailing edge margin. When the distance falls to or below the automatic-cutter sensor trailing edge margin, CPU 16 continues conveying label sheet 20, and proceeds to Step SP29 to switch the automatic-cutter sensor 34 to the constant driving mode. CPU 16 then proceeds to Step SP30. The automatic-cutter sensor trailing edge margin is a distance in conveyance direction df from when automatic-cutter sensor 34 in the intermittent driving mode is switched to the constant driving mode to when the detection target point of automatic-cutter sensor 34 passes label trailing edge Le. In the embodiment, the automatic-cutter sensor trailing edge margin is set to 10% of reference label length SLL, as with the automatic-cutter sensor leading edge margin.

In Step SP30, CPU 16 determines whether image formation apparatus 1 has printed the set number of sheets. When the determination in Step SP30 is negative, this indicates that there is still label 26 to be printed. CPU 16 then proceeds back to Step SP23 to wait for the detection of label leading edge Lf of label 26. Label leading edge Lf is immediately rearward, in the conveyance direction df, of gap 24 which has just been detected. When the determination in Step SP30 is negative, CPU 16 proceeds to Step SP31 to end automatic-cutter sensor drive control processing RT2.

As described above, CPU 16 drives automatic-cutter sensor 34 intermittently while an intermittent driving area on label 26 is passing the detection target point of automatic-cutter sensor 34. The intermittent driving area extends from a point which is shifted from label leading edge Lf rearward in conveyance direction df by the automatic-cutter sensor leading edge margin to a point which is shifted from label trailing edge Le frontward in conveyance direction df by the automatic-cutter sensor trailing edge margin.

1-4. Image Formation Unit Sensor Drive Control Processing

Figure 6:
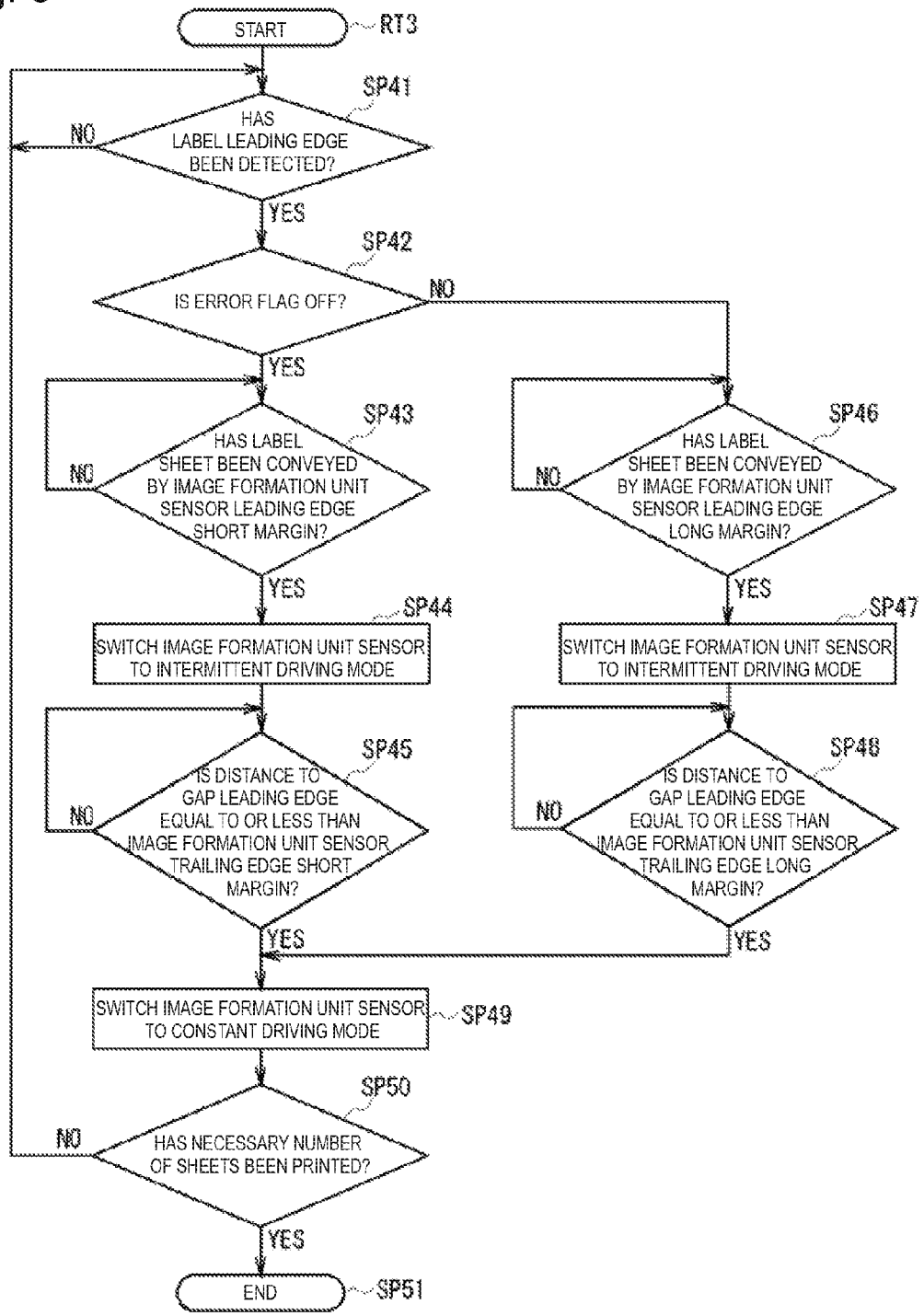
FIG. 6 is a flowchart illustrating image formation unit sensor drive control processing.

Using the flowchart in FIG. 6, a detailed description is given of the image formation unit sensor drive control processing performed by image formation apparatus 1. After ending label-length gap-length measurement processing RT1, CPU 16 starts image formation unit sensor drive control processing RT3 by executing an image formation unit sensor drive control processing program read from the ROM. CPU 16 then proceeds to Step SP41. In this state, CPU 16 is driving image formation unit sensor 40 in the constant driving mode and is continuing the conveyance of label sheet 20.

In Step SP41, CPU 16 determines whether image formation unit sensor 40 has detected label leading edge Lf of label 26 on label sheet 20. Upon detection of label leading edge Lf, CPU 16 proceeds to Step SP42 to determine whether the error flag is off.

When the determination in Step SP42 is affirmative, indicating that the error between reference label length SLL and detected label length LL2 is small, CPU 16 proceeds to Step SP43 to wait until label sheet 20 is conveyed by a distance of an image formation unit sensor leading edge short margin, the distance starting from label leading edge Lf detected in Step SP41. When label sheet 20 is conveyed by that distance, CPU 16 proceeds to Step SP44 while continuing the conveyance of label sheet 20. In Step SP44, CPU 16 switches image formation unit sensor 40 to the intermittent driving mode, and proceeds to Step SP45. The image formation unit sensor leading edge short margin is used when the error between detected label length LL2 and reference label length SLL is equal to or less than the allowable error, and is a distance in conveyance direction df from when the detection target point of image formation unit sensor 40 in the constant driving mode passes label leading edge Lf to when image formation unit sensor 40 is switched to the intermittent driving mode. In the present embodiment, the image formation unit sensor leading edge short margin is set to 5% of reference label length SLL, which is smaller than the automatic-cutter sensor leading edge margin.

In Step SP45, CPU 16 waits until a distance, from a point on label 26 currently passing the detection target point of image formation unit sensor 40 to gap leading edge Gf of gap 24 immediately rearward, in conveyance direction df, of label 26 currently detected by image formation unit sensor 40, falls to or below a distance of an image formation unit sensor trailing edge short margin. When this distance falls to or below the image formation unit sensor trailing edge short margin, CPU 16 proceeds to Step SP49 while continuing to convey label sheet 20. The image formation unit sensor trailing edge short margin is used when the error between detected label length LL2 and reference label length SLL is equal to or less than the allowable error, and is a distance in conveyance direction df from when image formation unit sensor 40 in the intermittent driving mode is switched to the constant driving mode to when the detection target point of image formation unit sensor 40 passes label trailing edge Le. In the present embodiment, the image formation unit sensor trailing edge short margin is set to 5% of reference label length SLL, which is equal to the image formation unit sensor leading edge short margin and is smaller than the automatic-cutter sensor trailing edge margin.

When the determination in Step SP42 is negative, this indicates that the error between reference label length SLL and detected label length LL2 is large. In this case, CPU 16 proceeds to Step SP46 to wait until label sheet 20 is conveyed by a distance of an image formation unit sensor leading edge long margin, the distance starting from label leading edge Lf detected in Step SP41. When label sheet 20 is conveyed by the image formation unit sensor leading edge long margin, CPU 16 proceeds to Step SP47 while continuing the conveyance of label sheet 20. In Step SP47, CPU 16 switches image formation unit sensor 40 to the intermittent driving mode, and proceeds to Step SP48. The image formation unit sensor leading edge long margin is used when the error between detected label length LL2 and reference label length SLL exceeds the allowable error, and is a distance in conveyance direction df from when the detection target point of image formation unit sensor 40 in the constant driving mode passes label leading edge Lf to when image formation unit sensor 40 is switched to the intermittent driving mode. In the present embodiment, the image formation unit sensor leading edge long margin is set to 10% of reference label length SLL, which is equal to the automatic-cutter sensor leading edge margin and is larger than the image formation unit sensor leading edge short margin.

In Step SP48, CPU 16 waits until a distance from a point on label 26 currently passing the detection target point of image formation unit sensor 40 to gap leading edge Gf of gap 24 immediately rearward, in conveyance direction df, of label 26 currently detected by image formation unit sensor 40 falls to or below a distance of an image formation unit sensor trailing edge long margin. When this distance falls to or below the image formation unit sensor trailing edge long margin, CPU 16 proceeds to Step SP49 while continuing to convey label sheet 20. The image formation unit sensor trailing edge long margin is used when the error between detected label length LL2 and reference label length SLL exceeds the allowable error, and is a distance in conveyance direction df from when image formation unit sensor 40 in the intermittent driving mode is switched to the constant driving mode to when the detection target point of image formation unit sensor 40 passes label trailing edge Le. In the present embodiment, the image formation unit sensor trailing edge long margin is set to 10% of reference label length SLL, which is equal to the image formation unit sensor leading edge long margin and larger than the image formation unit sensor trailing edge short margin. Hereinbelow, the image formation unit sensor leading edge short margin and the image formation unit sensor leading edge long margin are also collectively referred to as an image formation unit sensor leading edge margin, and the image formation unit sensor trailing edge short margin and the image formation unit sensor trailing edge long margin are also collectively referred to as an image formation unit sensor trailing edge margin.

In Step SP49, CPU 16 switches image formation unit sensor 40 to the constant driving mode, and proceeds to Step SP50. In Step SP50, CPU 16 determines whether image formation apparatus 1 has printed the set number of sheets. When the determination in Step SP50 is negative, this indicates that there is still label 26 to be printed. In this case, CPU 16 proceeds back to Step SP41 and waits for the detection of label leading edge Lf of label 26 immediately rearward, in conveyance direction df, of gap 24 which has just been detected. When the determination in Step S50 is affirmative, the CPU 16 proceeds to Step SP51 and ends image formation unit sensor drive control processing RT3.

As described, CPU 16 drives image formation unit sensor 40 intermittently while the intermittent driving area on label 26 is passing the detection target point of image formation unit sensor 40. The intermittent drive area extends from a point which is shifted from label leading edge Lf rearward in conveyance direction df by the image formation unit sensor leading edge short margin or the image formation unit sensor leading edge long margin to a point which is shifted from label trailing edge Le frontward in conveyance direction df by the image formation unit sensor trailing edge short margin or the image formation unit sensor trailing edge long margin.

1-5. Operation and Advantageous Effects

Optical sensors are controlled such that they emit light at a certain output power a certain number of times per unit time. Assuming that the intensity of the light emission is constant, the life of an optical sensor is determined by the period of time its light emitting part is on. A conventional image formation apparatus drives its optical sensor in a constant driving mode all the time during the conveyance of label sheet 20, causing the optical sensor to perform constant light emission frequently.

By contrast, image formation apparatus 1 operates as follows. Upon the start of printing, image formation apparatus 1 measures label length LL and gap length LG of each of multiple sets of label 26 and gap 24 of label sheet 20 from the frontmost label 26 in conveyance direction df and calculates reference label length SLL and reference gap length SLG. Based on reference label length SLL and reference gap length SLG, image formation apparatus 1 switches automatic-cutter sensor 34 or image formation unit sensor 40 to the intermittent driving mode when the detection target point of automatic-cutter sensor 34 or image formation unit sensor 40 is not positioned at label leading edge boarder Bf or label trailing edge boarder Be. For this reason, image formation apparatus 1 can reduce the period of time that automatic-cutter sensor 34 and image formation unit sensor 40 emit a detection light, compared to a case where they are kept driven in the constant driving mode. Thus, the number of light emissions, which corresponds to the life of the optical sensors, can be used unwastefully.

When the error flag is off, image formation apparatus 1 assumes that label 26 is not shifted in position so much, and drives image formation unit sensor 40 in the intermittent driving mode in the intermittent drive area on label 26. This intermittent drive area extends from the point shifted from label leading edge Lf rearward in conveyance direction df by the image formation unit sensor leading edge short margin, which is shorter than the automatic-cutter sensor leading edge margin, to the point shifted from label trailing edge Le frontward in conveyance direction df by the image formation unit sensor trailing edge short margin, which is shorter than the automatic-cutter sensor trailing edge margin. Image formation apparatus 1 thus makes the intermittent driving area longer when the error flag is off than when the error flag is on. The error flag being off means that the error between detected label length LL2 and reference label length SLL is equal to or less than the allowable error. Thus, even if the intermittent driving area is long, it is very unlikely that image formation unit sensor 40 fails to detect the position of label 26 by being driven in the intermittent driving mode when the detection target point of image formation unit sensor 40 is positioned at label leading edge boarder Bf or label trailing edge boarder Be. In image formation apparatus 1, image formation unit sensor 40 is placed in a high-temperature environment, and is therefore likely to have a shorter life than automatic-cutter sensor 34 by being affected by heat. To overcome this problem, image formation apparatus 1 makes the intermittent driving area longer for image formation unit sensor 40 than for automatic-cutter sensor 34, when the error flag is off. Thus, image formation apparatus 1 can compensate for the decrease in the life of image formation unit sensor 40 due to heat, and can increase the life of image formation unit sensor 40 as well as automatic-cutter sensor 34. In this way, according to the error in label length LL detected by automatic-cutter sensor 34, image formation apparatus 1 changes the timing for switching image formation unit sensor 40 to the intermittent light emission operation. Image formation apparatus 1 can thereby increase the life of image formation unit sensor 40 by extending the intermittent driving area for image formation unit sensor 40 while preventing image formation unit sensor 40 from failing to detect the position of label 26.

Figure 7:
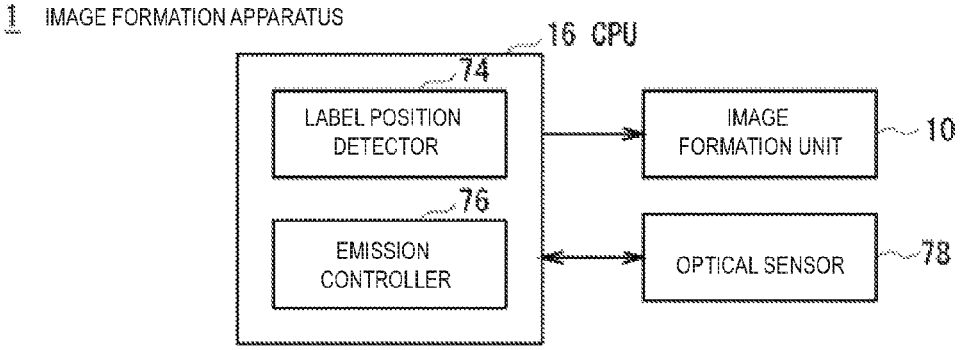
FIG. 7 is a block diagram illustrating functions of the image formation apparatus.

FIG. 7 is a functional block diagram illustrating basic functions of image formation apparatus 1, related to the label-length gap-length measurement processing, the automatic-cutter sensor drive control processing, and the image formation unit sensor drive control processing. In FIG. 7, label position detector 74 and emission controller 76 correspond to CPU 16 (FIG. 2), and optical sensor 78 corresponds to automatic-cutter sensor 34 and image formation unit sensor 40 (FIG. 2). The functional blocks of label position detector 74 and emission controller 76 are implemented when CPU 16 executes the predetermined label-length gap-length measurement processing program, automatic-cutter sensor drive control processing program, and image formation unit sensor drive control processing program. Label position detector 74 detects the position of label 26 of label sheet 20 by causing optical sensor 78 to emit light. Emission controller 76 controls optical sensor 78 so that optical sensor 78 is driven constantly while label sheet 20 is situated at a position where label position detector 74 detects the position of label 26 and so that optical sensor 78 is driven intermittently while label sheet 20 is situated at a position where label position detector 74 does not detect the position of label 26.

According to the configuration described thus far, image formation apparatus 1 includes: feeder unit 12 which picks up and feeds label sheet 20 to a conveyance path, wherein label sheet 20 is formed by temporarily attaching or detachably adhering labels 26 to long base sheet 22 in a longitudinal direction of base sheet 22 with gap 24 of a predetermined length interposed between labels 26; conveyance rollers 32, 33 and discharge rollers 48 which convey label sheet 20; automatic-cutter sensor 34 and image formation unit sensor 40 which are placed along the conveyance path and which emit detection light to label sheet 20 conveyed by conveyance rollers 32, 33 and discharge rollers 48, to detect the position of each label 26 on label sheet 20; image formation unit 10 which is placed downstream of automatic-cutter sensor 34 and image formation unit sensor 40 in conveyance direction df and which forms an image on label 26 detected by automatic-cutter sensor 34 and image formation unit sensor 40; and CPU 16 which controls conveyance rollers 32, 33, discharge rollers 48, automatic-cutter sensor 34, image formation unit sensor 40, and image formation unit 10. CPU 16 switches automatic-cutter sensor 34 and image formation unit sensor 40 between constant light emission operation in which they constantly emit the detection light and intermittent light emission operation in which they intermittently emit the detection light. Image formation apparatus 1 causes automatic-cutter sensor 34 and image formation unit sensor 40 to perform the constant light emission operation for the area that needs an accurate detection of label 26, and to emit light at long intervals for the area that does not need an accurate detection of label 26. Image formation apparatus 1 thereby achieves a reduction in the number (time) of light emissions per unit time, allowing an effective use of the number of times the optical sensors emit light until the end of their lives.

2. Other Embodiments

In the embodiment described above, automatic-cutter sensor 34 and image formation unit sensor 40 in the intermittent driving mode emit detection light intermittently by keep turning on and off on a predetermined regular cycle. The invention is not limited to this. For a center area on label 26 in conveyance direction df, which is far away from label trailing edge boarder Be to be detected next, image formation apparatus 1 may extend the cycle of intermittent light emission (intermittent driving cycle), or in other words, decrease the frequency of detection light emission, allowing a further increase in the lives of automatic-cutter sensor 34 and image formation unit sensor 40. Meanwhile, for an area near label trailing edge boarder Be, image formation apparatus 1 may shorten the cycle of intermittent light emission (intermittent driving cycle), or in other words, increase the frequency of detection light emission to ensure the detection of label trailing edge boarder Be.

The intermittent driving cycle is the total of a period in which the LED of automatic-cutter sensor 34 or image formation unit sensor 40 is on (on-time) and a period in which the LED is off (off-time). There is a limit in shortening the on-time of an LED because it is necessary to set aside the time required for the LED of automatic-cutter sensor 34 or image formation unit sensor 40 to stabilize after starting its light emission, the time required by CPU 16 to acquire a detection result from automatic-cutter sensor 34 or image formation unit sensor 40, and the time required by CPU 16 to process the detection result. For this reason, to adjust the intermittent driving cycle, the off-time of the LED is adjusted. Specifically, to shorten the intermittent driving cycle, the off-time of the LED is shortened. Thus, the intermittent driving cycle indicates the cycle of turning on the LED of automatic-cutter sensor 34 or image formation unit sensor 40 for a certain period of time.

In the embodiment described above, automatic-cutter sensor 34 and image formation unit sensor 40 are switched to the constant driving mode for a normal driving state in which label leading edge boarder Bf and label trailing edge boarder Be are detected, and switched to the intermittent driving mode for a low-emission driving state in which label leading edge boarder Bf and label trailing edge boarder Be are not detected. The invention is not limited to this. Automatic-cutter sensor 34 and image formation unit sensor 40 may be driven in the intermittent driving mode for the normal driving state, as well. In this case, the intermittent driving cycle for automatic-cutter sensor 34 and image formation unit sensor 40 is longer for the low emission driving state than for the normal driving state. In other words, it is desirable that the intermittent driving cycle be shorter for the area near label leading edge boarder Bf and label trailing edge boarder Be than for the center area of label 26 in conveyance direction df so that label leading edge boarder Bf and label trailing edge boarder Be can be detected with high accuracy. Note that, desirably, automatic-cutter sensor 34 and image formation unit sensor 40 are not turned off completely in the low emission driving state. This is in order to be able to determine the presence of label 26 based on a detection result and detect abnormality such as paper jam during the low emission driving state, too.

In the embodiment described above, automatic-cutter sensor 34 and image formation unit sensor 40 are each driven in the intermittent driving mode when label sheet 20 is located at a position where automatic-cutter sensor 34 or image formation unit sensor 40 detects the center area of label 26 in conveyance direction df. The invention is not limited to this. If gap length LG is large, automatic-cutter sensor 34 and image formation unit sensor 40 may be each driven in the intermittent driving mode when label sheet 20 is located at a position where automatic-cutter sensor 34 or image formation unit sensor 40 detects the center area of gap 24 in conveyance direction df.

In the embodiment described above, image formation apparatus 1 detects the position of label 26 by detecting label leading edge boarder Bf and label trailing edge boarder Be and thereby measuring label length LL and gap length LG. The invention is not limited to this. Image formation apparatus 1 may detect the position of label 26 by detecting black marks 28 and a portion of base sheet 22 excluding black marks 28 and thereby measuring the pitch between black marks 28, i.e., the pitch of label leading edge boarder Bf. Alternatively, image formation apparatus 1 may detect the position of label 26 by detecting at least label leading edge boarder Bf, without detecting label trailing edge boarder Be. It is however preferable to detect label trailing edge boarder Be as well in order to, for example, measure the size of label 26 accurately and make a correction so that image data may not be printed outside label 26. If label leading edge boarder Bf is not detected and only label trailing edge boarder Be is detected, image formation apparatus 1 cannot handle a certain variation of gap length LG. Thus, it is preferable to detect at least label leading edge boarder Bf to determine an accurate position for starting the image formation.

In the embodiment described above, image formation apparatus 1 calculates reference label length SLL and reference gap length SLG based on measured label lengths LL1 and measured gap lengths LG1 obtained by automatic-cutter sensor 34. The invention is not limited to this. For example, if automatic-cutter sensor 34 and image formation unit sensor 40 differ in their configuration, the type of sensor used, or the like, image formation apparatus 1 may calculate reference label length SLL and reference gap length SLG based on measured label lengths LL1 and measured gap lengths LG1 additionally obtained by image formation unit sensor 40 in a similar manner to automatic-cutter sensor 34, and use these, i.e. the reference label length SLL and reference gap length SLG, in image formation unit sensor drive control processing RT3.

In the embodiment described above, label measurement count CL is three, and the average of three measured label lengths LL1 and the average of three measured gap lengths LG1 are used as reference label length SLL and reference gap length SLG, respectively. The invention is not limited to this. Label measurement count CL may be one, two, four, or more. When label measurement count CL is one, measured label length LL1 and measured gap length LG1 are obtained only once and are used as reference label length SLL and reference gap length SLG. Label measurement count CL may be appropriately set depending on the conveyance accuracy of image formation apparatus 1 and the dimensional accuracy of labels 26 used.

In the embodiment described above, image formation apparatus 1 determines whether the error between the detected label length LL2 and reference label length SLL, which is the average of measured label lengths LL1 obtained by automatic-cutter sensor 34, is equal to or less than the allowable error. The invention is not limited to this. Image formation apparatus 1 may use a preset fixed value as the reference label length SLL and determine whether an error between detected label length LL2 and the preset fixed value is equal to or less than an allowable error.

In the embodiment described above, image formation apparatus 1 determines whether the error between reference label length SLL and detected label length LL2, which is label length LL of the fourth label 26 from the start of printing, is equal to or less than the allowable error. The invention is not limited to this. Image formation apparatus 1 may detect label length LL of every label 26 from the fifth label 26 from the start of printing, and determine the error between this label length LL and reference label length SLL.

In the embodiment described above, the allowable error is 1%. The invention is not limited to this. The allowable error may be any value other than 1%. When the allowable error is a large value, a relatively large error between detected label length LL2 and reference label length SLL falls within the range of the allowable error, keeping the error flag off and therefore employing the image formation unit sensor leading edge short margin and the image formation unit sensor trailing edge short margin. This increases the possibility for image formation unit sensor 40 to fail to detect the position of label 26, but on the other hand, increases the life of image formation unit sensor 40 by extending the period in which image formation unit sensor 40 is driven in the intermittent driving mode. When the allowable error is a small value, even a slight error between the detected label length LL2 and reference label length SLL falls out of the range of the allowable error, turning the error flag on and therefore employing the image formation unit sensor leading edge long margin and the image formation unit sensor trailing edge long margin. This makes image formation unit sensor 40 to be driven in the intermittent driving mode for the same period of time as automatic-cutter sensor 34, but it can lower the possibility for image formation unit sensor 40 to fail to detect the position of label 26.

In the embodiment described above, the automatic-cutter sensor leading edge margin and automatic-cutter sensor trailing edge margin are each set to 10% of reference label length SLL. The invention is not limited to this. The automatic-cutter sensor leading edge margin and automatic-cutter sensor trailing edge margin may each be any value other than 10%, or any value, such as a fixed value, not dependent on the value of reference label length SLL. Setting a small value as the automatic-cutter sensor leading edge margin and automatic-cutter sensor trailing edge margin increases the possibility for automatic-cutter sensor 34 to fail to detect the position of label 26, but on the other hand, it can increase the life of automatic-cutter sensor 34 by extending the period in which automatic-cutter sensor 34 is driven in the intermittent driving mode. Setting large values for the automatic-cutter sensor leading edge margin and automatic-cutter sensor trailing edge margin does not extend the period in which automatic-cutter sensor 34 is in the intermittent driving mode, but on the other hand, it can lower the possibility for automatic-cutter sensor 34 to fail to detect the position of label 26. The automatic-cutter sensor leading edge margin and automatic-cutter sensor trailing edge margin are set appropriately according to the conveyance accuracy of image formation apparatus 1, the dimensional accuracy of labels 26 used, and the detection accuracy of automatic-cutter sensor 34. In the embodiment described above, the automatic-cutter sensor leading edge margin and automatic-cutter sensor trailing edge margin are set to the same value. The invention is not limited to this. The automatic-cutter sensor leading edge margin and automatic-cutter sensor trailing edge margin do not have to be the same value, and may be values different from each other.

In the embodiment described above, the image formation unit sensor leading edge long margin and image formation unit sensor trailing edge long margin are each set to 10% of reference label length SLL. The invention is not limited to this. The image formation unit sensor leading edge long margin and image formation unit sensor trailing edge long margin may each be any value other than 10%, or any value, such as a fixed value, not dependent on the value of reference label length SLL. Setting a small value as the image formation unit sensor leading edge long margin and image formation unit sensor trailing edge long margin increases the possibility for image formation unit sensor 40 to fail to detect the position of label 26, but on the other hand, it can increase the life of image formation unit sensor 40 by extending the period in which image formation unit sensor 40 is driven in the intermittent driving mode. Setting a large value as the image formation unit sensor leading edge long margin and image formation unit sensor trailing edge long margin does not extend the period in which image formation unit sensor 40 is driven in the intermittent driving mode, but on the other hand, it can lower the possibility for image formation unit sensor 40 to fail to detect the position of label 26. The image formation unit sensor leading edge long margin and image formation unit sensor trailing edge long margin are set appropriately according to the conveyance accuracy of image formation apparatus 1, the dimensional accuracy of labels 26 used, and the detection accuracy of image formation unit sensor 40. In the embodiment described above, the image formation unit sensor leading edge long margin and image formation unit sensor trailing edge long margin are set to the same value. The invention is not limited to this. The image formation unit sensor leading edge long margin and image formation unit sensor trailing edge long margin do not have to be the same value, and may be values different from each other.

In the embodiment described above, the image formation unit sensor leading edge short margin and image formation unit sensor trailing edge short margin are each set to 5% of reference label length SLL. The invention is not limited to this. The image formation unit sensor leading edge short margin and image formation unit sensor trailing edge short margin may each be any value other than 5%, or any value, such as a fixed value, not dependent on the value of reference label length SLL. Setting a small value as the image formation unit sensor leading edge short margin and image formation unit sensor trailing edge short margin increases the possibility for image formation unit sensor 40 to fail to detect the position of label 26, but on the other hand, it can increase the life of image formation unit sensor 40 by extending the period in which image formation unit sensor 40 is driven in the intermittent driving mode. Setting a large value as the image formation unit sensor leading edge short margin and image formation unit sensor trailing edge short margin does not extend the period in which image formation unit sensor 40 is driven in the intermittent driving mode, but on the other hand, it can lower the possibility for image formation unit sensor 40 to fail to detect the position of label 26. The image formation unit sensor leading edge short margin and image formation unit sensor trailing edge short margin are set appropriately according to the conveyance accuracy of image formation apparatus 1, the dimensional accuracy of labels 26 used, and the detection accuracy of image formation unit sensor 40. In the embodiment described above, the image formation unit sensor leading edge short margin and image formation unit sensor trailing edge short margin are set to the same value. The invention is not limited to this. The image formation unit sensor leading edge short margin and image formation unit sensor trailing edge short margin do not have to be the same value, and may be values different from each other.

In the embodiment described above, the invention is applied to image formation apparatus 1 which includes both automatic cutter 36 and image formation unit 10 as well as automatic-cutter sensor 34 and image formation unit sensor 40 which correspond to automatic cutter 36 and image formation unit 10, respectively. The invention is not limited to this. The invention may be applied to an image formation apparatus which does not include automatic cutter 36 and automatic-cutter sensor 34.

In the embodiment described above, the invention is used to control automatic-cutter sensor 34 and image formation unit sensor 40 which are optical sensors. The invention is not limited to this, and may be used to control various other sensors, such as ultrasonic sensors.

In the embodiment described above, image formation apparatus 1 as an image formation apparatus is configured by including feeder unit 12 as a feeder, conveyance rollers 32, and discharge rollers 48 as a conveyance member, automatic-cutter sensor 34 and image formation unit sensor 40 as a detector, image formation unit 10 as an image formation unit, and CPU 16 as a controller. The invention is not limited to this. The image formation apparatus may be configured by including a feeder, a conveyance member, a detector, an image formation unit, and a controller which have various other configurations.

INDUSTRIAL APPLICABILITY

The invention can be used as an imaging formation apparatus or a conveyance apparatus that conveys a long medium formed by detachably attaching labels on a long base sheet at predetermined intervals.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. An image formation apparatus comprising:

a feeder that feeds a label sheet to a conveyance path, the label sheet including a long base sheet and labels detachably adhered to the base sheet with a gap of a predetermined length interposed in between in a longitudinal direction of the base sheet;

a conveyance member that conveys the fed label sheet along the conveyance path;

a detector that is placed along the conveyance path and that detects a position of at least one of the labels on the label sheet by emitting detection light to the label sheet being conveyed;

an image formation unit that is placed downstream of the detector in a conveyance direction and that forms an image on the label detected by the detector; and a controller that controls the conveyance member, the detector, and the image formation unit, wherein the controller switches the detector between a constant light emission operation of emitting the detection light constantly and an intermittent light emission operation of emitting the detection light intermittently, the controller causes the detector to detect the position of the label by detecting a label leading edge, which is a leading edge of the label in the conveyance direction, when the label sheet is at a position where the detector detects the label leading edge, the controller controls the detector so that the detector performs the constant light emission operation, and when the label sheet is located at a position where the detector does not detect the label leading edge, the controller controls the detector so that the detector performs the intermittent light emission operation.

2. The image formation apparatus according to claim 1, wherein when the label sheet is located at a position where the detector detects an area between the label leading edge and a label trailing edge, which is a trailing edge of the label in the conveyance direction, the controller switches the detector from the constant light emission operation to the intermittent light emission operation, and when the label sheet is thereafter located at a position where the detector detects the label trailing edge, the controller switches the detector to the constant light emission operation.

3. The image formation apparatus according to claim 2, wherein according to a position of the conveyed label relative to the detector, the controller changes a drive cycle on which the detector emits the detection light in the intermittent light emission operation.

4. The image formation apparatus according to claim 3, wherein the controller makes the drive cycle longer when the label sheet is located at a position where the detector detects a center portion between the label leading edge and the label trailing edge, than when the label sheet is located at a position where the detector detects any of the label leading edge and the label trailing edge.

5. The image formation apparatus according to claim 1, wherein the detector includes a transmission sensor and a reflective sensor.

6. The image formation apparatus according to claim 5, wherein the label sheet includes marks corresponding to the labels, the transmission sensor detects a position of the label based on differences between light transmittance between the base sheet and each of the labels, and the reflective sensor detects a position of the label based on differences in light reflectance between the base sheet and each of the marks.

7. The image formation apparatus according to claim 1, wherein the detector includes an upstream optical sensor and a downstream optical sensor placed downstream of the upstream optical sensor in the conveyance direction, and the controller controls a timing for switching the downstream optical sensor between the constant light emission operation and the intermittent light emission operation, according to a detection result of the position of the label obtained by the upstream optical sensor.

8. The image formation apparatus according to claim 7, wherein the controller switches the downstream optical sensor between the constant light emission operation and the intermittent light emission operation at different timings depending on whether or not an error between a certain reference value and the detection result of the position of the label obtained by the upstream optical sensor is less than a predetermined value.

9. The image formation apparatus according to claim 7, wherein the controller causes the downstream optical sensor to perform the intermittent light emission operation for a longer period when an error between a certain reference value and the detection result of the position of the label obtained by the upstream optical sensor is less than a predetermined value, than when the error is not less than the predetermined value.

10. The image formation apparatus according to claim 7, further comprising a cutter mechanism that is placed upstream of the image formation unit in the conveyance direction and that cuts the gap on the base sheet to divide the label sheet into the individual labels, wherein the upstream optical sensor is placed upstream of the cutter mechanism in the conveyance direction, the downstream optical sensor is placed upstream of the image formation unit in the conveyance direction, the controller controls the cutter mechanism according to the detection result of the position of the label obtained by the upstream optical sensor, and controls the image formation unit according to a detection result of the position of the label obtained by the downstream optical sensor, and the controller controls the timing for switching the downstream optical sensor between the constant light emission operation and the intermittent light emission operation, according to the detection result of the position of the label obtained by the upstream optical sensor.

11. An image formation apparatus comprising:

a feeder that feeds a label sheet to a conveyance path, the label sheet including a long base sheet and labels detachably adhered to the base sheet with a gap of a predetermined length interposed in between in a longitudinal direction of the base sheet;

a conveyance member that conveys the fed label sheet along the conveyance path;

a detector that is placed along the conveyance path and that detects a position of at least one of the labels on the label sheet by emitting detection light to the label sheet being conveyed;

an image formation unit that is placed downstream of the detector in a conveyance direction and that forms an image on the label detected by the detector; and a controller that controls the conveyance member, the detector, and the image formation unit, wherein the controller switches the detector between a constant light emission operation of emitting the detection light constantly and an intermittent light emission operation of emitting the detection light intermittently, the detector includes an upstream optical sensor and a downstream optical sensor placed downstream of the upstream optical sensor in the conveyance direction, and the controller controls a timing for switching the downstream optical sensor between the constant light emission operation and the intermittent light emission operation, according to a detection result of the position of the label obtained by the upstream optical sensor.

12. The image formation apparatus according to claim 11, wherein the controller switches the downstream optical sensor between the constant light emission operation and the intermittent light emission operation at different timings depending on whether or not an error between a certain reference value and the detection result of the position of the label obtained by the upstream optical sensor is less than a predetermined value.

13. The image formation apparatus according to claim 12, wherein the controller switches the downstream optical sensor between the constant light emission operation and the intermittent light emission operation at different timings depending on whether or not an error between a certain reference value and a measurement result of a label length obtained by the upstream optical sensor is less than a predetermined value, the label length being a length of the label in the conveyance direction.

14. The image formation apparatus according to claim 13, wherein the controller calculates an average of the measurement results of the label lengths of a predetermined number of the labels and uses the average as the reference value.

15. The image formation apparatus according to claim 11, wherein the controller causes the downstream optical sensor to perform the intermittent light emission operation for a longer period when an error between a certain reference value and the detection result of the position of the label obtained by the upstream optical sensor is less than a predetermined value, than when the error is not less than the predetermined value.

16. The image formation apparatus according to claim 11, further comprising a cutter mechanism that is placed upstream of the image formation unit in the conveyance direction and that cuts the gap on the base sheet to divide the label sheet into the individual labels, wherein the upstream optical sensor is placed upstream of the cutter mechanism in the conveyance direction, the downstream optical sensor is placed upstream of the image formation unit in the conveyance direction, the controller controls the cutter mechanism according to the detection result of the position of the label obtained by the upstream optical sensor, and controls the image formation unit according to a detection result of the position of the label obtained by the downstream optical sensor, and the controller controls the timing for switching the downstream optical sensor between the constant light emission operation and the intermittent light emission operation, according to the detection result of the position of the label obtained by the upstream optical sensor.

17. The image formation apparatus according to claim 11, wherein the detector includes a transmission sensor and a reflective sensor.

18. The image formation apparatus according to claim 17, wherein the label sheet includes marks corresponding to the labels, the transmission sensor detects a position of the label based on differences between light transmittance between the base sheet and each of the labels, and the reflective sensor detects a position of the label based on differences in light reflectance between the base sheet and each of the marks.

19. An image formation method, comprising:

causing a feeder to feed a label sheet to a conveyance path, the label sheet including a long base sheet and a plurality of labels detachably adhered to the base sheet with a gap of a predetermined length interposed in between in a longitudinal direction of the sheet;

causing a conveyance member to convey the fed label sheet along the conveyance path;

causing a detector placed along the conveyance path to detect a position of each label on the label sheet by emitting a detection light to the label sheet being conveyed, wherein the label position detection step includes a constant light emission operation of emitting the detection light constantly and an intermittent light emission operation of emitting the detection light intermittently; and causing an image formation unit placed downstream of the detector in a conveyance direction to form an image on the label detected by the detector, wherein the controller causes the detector to detect the position of the label by detecting a label leading edge, which is a leading edge of the label in the conveyance direction, when the label sheet is at a position where the detector detects the label leading edge, the controller controls the detector so that the detector performs the constant light emission operation, and when the label sheet is located at a position where the detector does not detect the label leading edge, the controller controls the detector so that the detector performs the intermittent light emission operation.

* * * * *